US009719741B1

(12) United States Patent
Cifers et al.

(10) Patent No.: US 9,719,741 B1
(45) **Date of Patent: *Aug. 1, 2017**

(54) MAGAZINE LOADING DEVICE

(71) Applicant: MagPump, LLC, Rochester, NY (US)

(72) Inventors: Luther Cifers, Amelia, VA (US); Kenneth P. Green, Lunenburg, VA (US)

(73) Assignee: MagPump, LLC, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/166,269

(22) Filed: May 27, 2016

Related U.S. Application Data

(63) Continuation-in-part of application No. 14/597,054, filed on Jan. 14, 2015, now Pat. No. 9,354,008.

(60) Provisional application No. 61/927,431, filed on Jan. 14, 2014.

(51) Int. Cl.
*F41A 9/82* (2006.01)
*F41A 9/83* (2006.01)

(52) U.S. Cl.
CPC ..... *F41A 9/83* (2013.01)

(58) Field of Classification Search
CPC ..... F41A 9/82; F41A 9/83; F41A 9/01; F41A 9/06; F41A 9/07; F41A 9/09; F41A 9/10; F41A 9/11; F41A 9/66; F42B 33/002
USPC ..... 86/26
See application file for complete search history.

(56) References Cited

U.S. PATENT DOCUMENTS 1,786,537 A * 12/1930 Holek ..... F41A 9/83 42/87
2,326,816 A * 8/1943 Woodberry ..... F42B 39/10 86/45
2,419,242 A * 4/1947 Woodberry ..... F42B 39/10 193/47
2,451,521 A * 10/1948 Uglum ..... F41A 9/83 244/155 A
2,623,803 A * 12/1952 Gamble ..... F42B 39/002 144/245.1
2,783,570 A * 3/1957 Kunz ..... F41A 9/66 42/18
3,628,273 A * 12/1971 Lach ..... F41A 9/83 224/196
3,789,531 A * 2/1974 Kersten ..... F42B 39/00 206/3
4,736,667 A * 4/1988 Kochevar ..... F41A 9/83 206/3
4,739,572 A * 4/1988 Brandenburg ..... F41A 9/83 42/87

(Continued)

*Primary Examiner* — Derrick Morgan
(74) *Attorney, Agent, or Firm* — Barclay Damon, LLP

(57) ABSTRACT

A magazine loading device comprises an ammunition delivery interface, a shuttle or escapement, an orientation gate, a staging gate, a plunger, and a magazine receiver. The ammunition may be supplied to the ammunition delivery interface in a number of ways, including utilization of a hopper. The ammunition may be guided into an opening in the shuttle or escapement, which may then transfer the ammunition to an orientation gate. The geometry of the orientation gate is such that the ammunition will always drop through the orientation gate with the projectile down, which in this case is the desired orientation for loading into the magazine. A plunger may then push the ammunition into the magazine.

20 Claims, 16 Drawing Sheets

(56) References Cited

U.S. PATENT DOCUMENTS

| | | | | |
|---|---|---|---|---|
| 4,949,495 | A * | 8/1990 | Mari | F41A 9/83 42/87 |
| 5,301,449 | A * | 4/1994 | Jackson | F41A 9/83 42/87 |
| 6,754,987 | B1 * | 6/2004 | Cheng | F41A 9/83 42/87 |
| 7,059,077 | B2 * | 6/2006 | Tal | F41A 9/83 42/88 |
| 9,091,500 | B1 * | 7/2015 | Kim | F41A 9/83 |
| 2003/0046854 | A1 * | 3/2003 | Urchek | F41A 9/83 42/87 |
| 2005/0081421 | A1 * | 4/2005 | Guy | F41A 9/83 42/88 |
| 2014/0033592 | A1 * | 2/2014 | Fiorucci | F41A 9/83 42/87 |
| 2014/0311008 | A1 * | 10/2014 | McPhee | F41A 9/83 42/87 |
| 2014/0317985 | A1 * | 10/2014 | Cauley, Jr. | F41A 9/83 42/87 |
| 2015/0377573 | A1 * | 12/2015 | Niccum | F41A 9/83 42/87 |

* cited by examiner

MAGAZINE LOADING DEVICE

CROSS-REFERENCE TO RELATED APPLICATIONS

This application is a continuation-in-part of U.S. patent application Ser. No. 14/597,054, filed Jan. 14, 2015, which claims the benefit of U.S. Provisional Application No. 61/927,431, filed Jan. 14, 2014, the disclosures of which is incorporated herein by reference.

BACKGROUND OF THE INVENTION

This invention relates in general to firearms, and more particularly to magazine chargers.

Rifles with detachable magazines are widely used in military, law enforcement, recreational, and hunting activities. Some of these activities involve the use of many rounds of ammunition and therefore require frequent, repeated loading of magazines. While it is possible and common for magazines to be manually loaded, it may be a time consuming and physically demanding activity.

In some cases, ammunition may be purchased already attached to a carrier commonly known as a stripper clip. When used in conjunction with a loading fixture, the stripper clip allows the ammunition to be rapidly loaded into a magazine. However, stripper clips are typically limited to ten rounds of ammunition, while magazines commonly require thirty rounds or more. Also, ammunition is often purchased loosely boxed and disoriented rather than attached to stripper clips, and in these cases the rounds of ammunition must be handled individually.

There have been various inventions proposed that address different challenges associated with loading ammunition into detachable magazines. Some are designed to reduce the physical burden of forcing the ammunition into the magazine, and some are designed to reduce the time required to load ammunition into the magazine. However, each proposed solution is limited in some way. In some cases, the physical burden may be reduced but the process remains time consuming. In other cases, the ammunition may be rapidly loaded but only after each round is correctly oriented and aligned into a fixture. In previously proposed solutions for loading loose ammunition into magazines, each individual round must be handled either to be loaded into the magazine or to be staged in a fixture for subsequent loading.

There remains a need for a magazine loading device capable of loading loose, disoriented ammunition to a magazine, that does not require each individual round to be handled and that orients each round of ammunition correctly before insertion into the magazine.

SUMMARY OF THE INVENTION

The present invention relates to a magazine loading device which may be manually actuated or actuated by electromechanical or other actuator.

A magazine loading device may comprise an assembly, which may include an ammunition delivery interface, a shuttle, an orientation gate, a staging gate, a plunger, and a magazine receiver. The shuttle may be replaced by an escapement.

The ammunition may be supplied to the ammunition delivery interface in a number of ways, including utilization of a hopper. The ammunition may be guided into an opening in the shuttle or escapement, which may then transfer the ammunition to an orientation gate.

The geometry of the orientation gate may be such that the ammunition will always drop through the orientation gate with the projectile down, which in this case is the desired orientation for loading into the magazine. A plunger may then push the ammunition into the magazine.

The plunger may be actuated by a cam or lever which may be driven by a manual crank, a manual lever, an electric motor, a linear actuator, or some other driver. The actuation system may be mounted to sliding members, the movement of which may be resisted by spring force. This may allow the actuation system to retract when the magazine is full or if there is resistance from some other source, such as a jammed round of ammunition. Movement of the plunger may be mechanically linked to the shuttle, so that when the plunger is actuated, the shuttle is actuated simultaneously, causing the shuttle and the plunger to act in reciprocal motion, either in phase with one another or opposite one another. Each may be returned from the actuation stroke by mechanical linkage, springs, gravity, or some other return.

Various advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
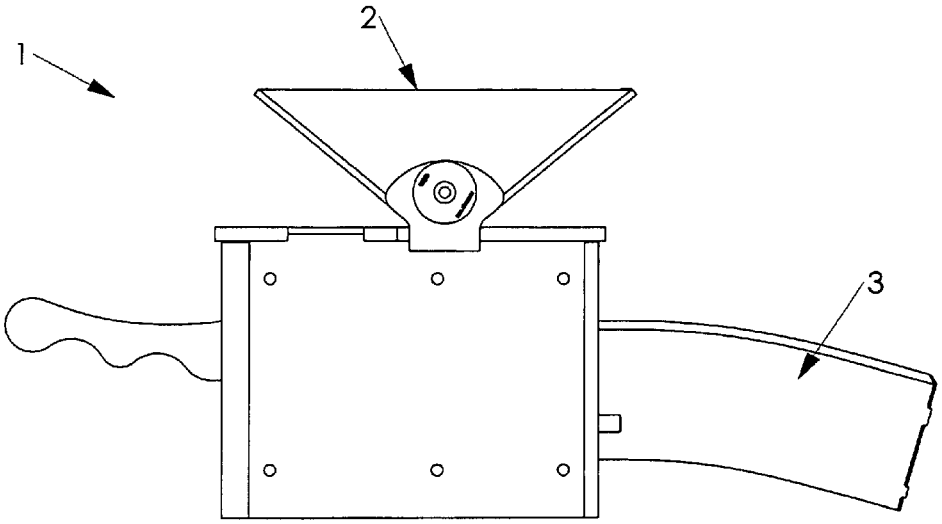
FIG. 1 is a side elevation view of a magazine loading device with a feed hopper installed and a magazine inserted.
Figure 2:
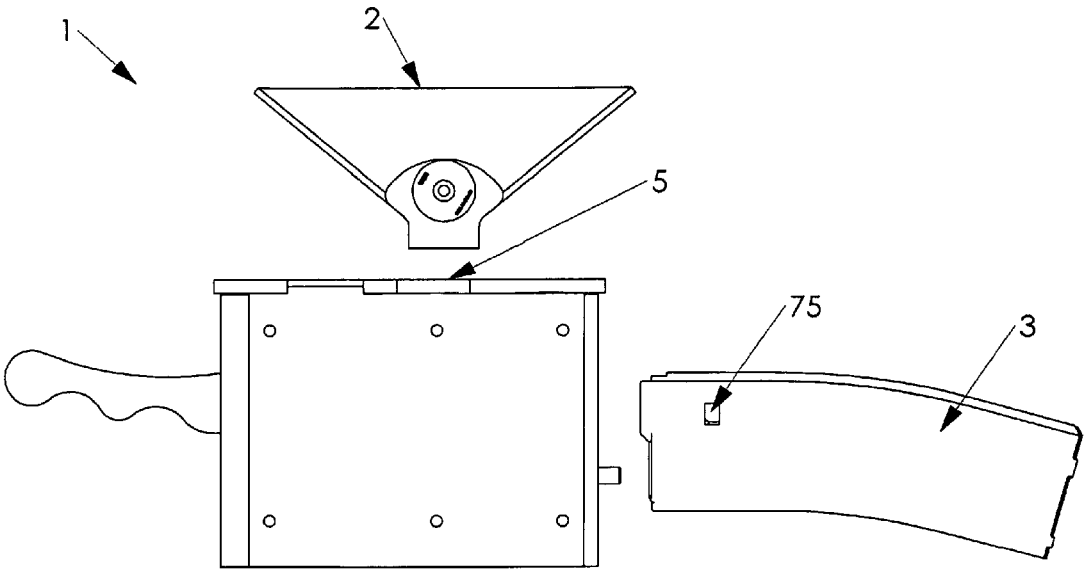
FIG. 2 is the magazine loading device of FIG. 1, with the feed hopper removed and a magazine removed.

Referring now to the drawings, there is illustrated in FIGS. 1 and 2 a magazine loading device 1 for loading of ammunition 4 (shown in FIG. 12), comprising a projectile end 22 with a projectile width 30 and a casing end 23 with a casing width 31, into a detachable magazine 3. The ammunition 4 may be delivered to an ammunition delivery interface 5 by a hopper 2. The ammunition 4 may alternately be delivered by individually manually loading or by some other loading, including an alternate fixed or detachable ammunition delivery system (not shown).

Figure 3:
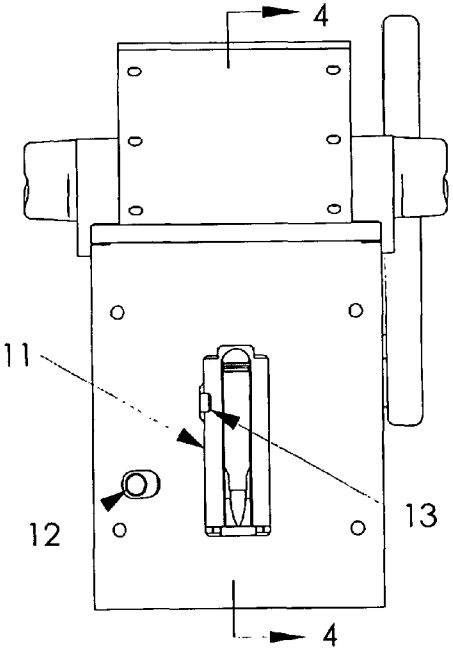
FIG. 3 is a front view of the magazine loading device in FIG. 2 with a manual actuation lever in a deactivated position.

The magazine 3 shown in FIG. 1 may be attached to the magazine loading device 1 by inserting the magazine 3 into the magazine receiver 11, which is shown in FIG. 3. Referring still to FIG. 3, a magazine retaining pin 13, which may be shaped to cooperate with a feature in the magazine 3, may be held in position by pressure from a spring or another source, and may retract as the geometry of the magazine 3 urges the magazine retaining pin 13 into a retracted state during insertion. An indention pocket 75 (shown in FIG. 2) may be present in the magazine 3 with which the magazine retaining pin 13 may interlock after the magazine 3 is fully inserted into the magazine receiver 11, thus preventing the magazine 3 from being ejected from the magazine receiver 11 until the magazine retaining pin 13 is retracted. Retraction of the magazine retaining pin 13 may be facilitated by actuation of a magazine release lever 12, as shown, by an alternate magazine release lever, or by some other form of release. The magazine release lever 12 may be mechanically linked to the magazine retaining pin 13, such as by a cam, linkage, or some other connection so that when the magazine release lever 12 is actuated, the magazine retaining pin 13 is retracted adequately to free the magazine retaining pin 13 from the indention pocket 75 in the magazine 3 so that the magazine 3 can be removed.

Figure 4:
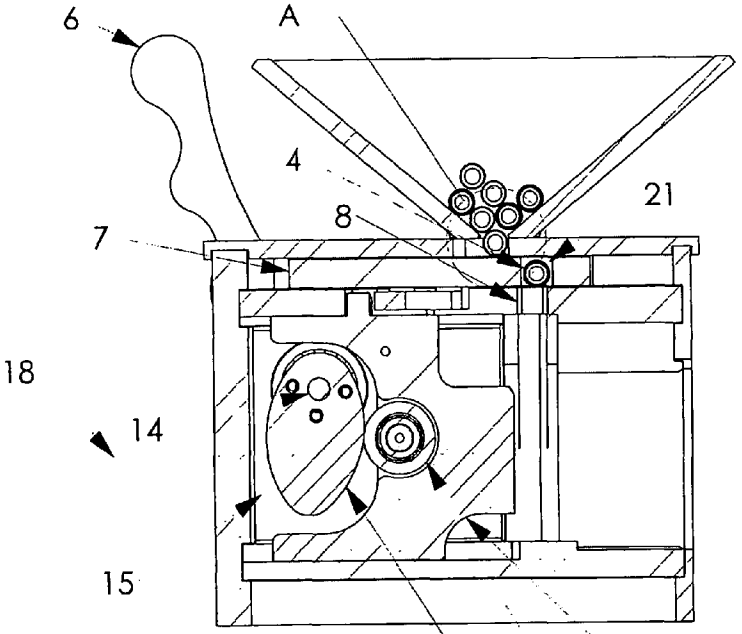
FIG. 4 is a cross-sectional view taken along line 4-4 in FIG. 3.
Figure 5:
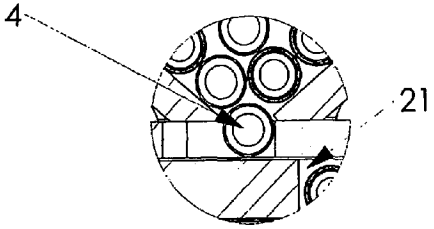
FIG. 5 is an enlarged detail view taken within circle A in FIG. 4.

Looking now at FIG. 4, it may be observed that an actuation lever 6 may be attached to a crank shaft 14. Rotational movement of the actuation lever 6 may cause the crank shaft 14 to rotate. An actuation cam 15 may also be attached to the crank shaft 14 so that when the crank shaft 14 is rotated, the surface 17 of the actuation cam 15 may engage a cam roller 16, which may be attached or mechanically linked to a plunger 10, urging the plunger 10 in the direction of actuation according to the shape of the surface 17 of the actuation cam 15. Therefore, when the actuation lever 6 is rotationally actuated, the actuation cam 15 may ultimately urge the plunger 10 along a plunger axis 18.

Figure 7:
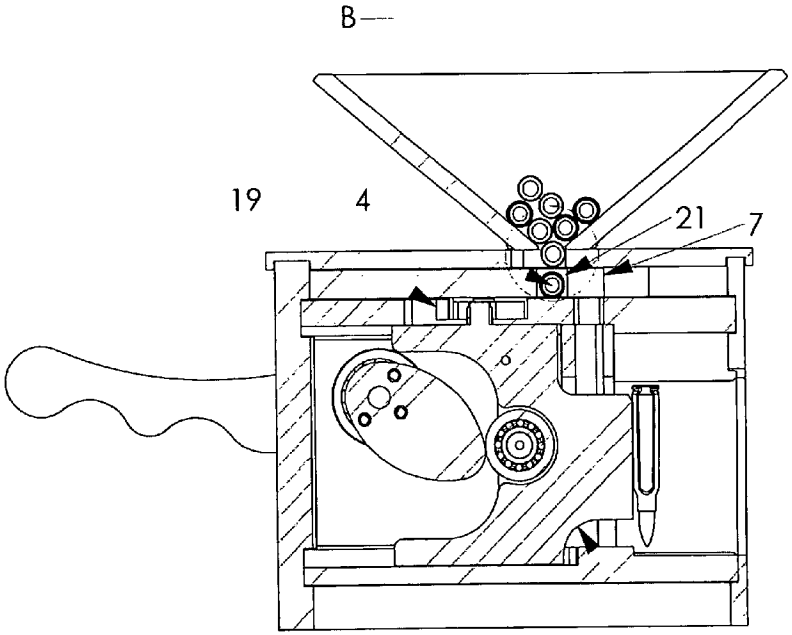
FIG. 7 is a cross-sectional view taken along line 7-7 in FIG. 6.
Figure 8:
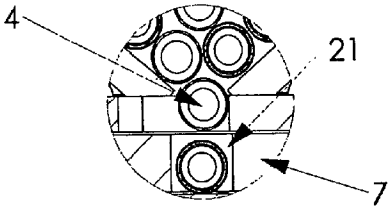
FIG. 8 is an enlarged detail view taken within circle B in FIG. 6.
Figure 6:
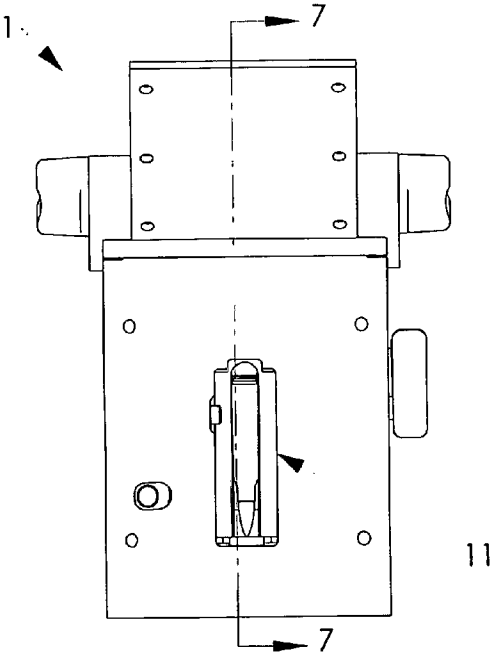
FIG. 6 is a front view of the magazine loading device in FIG. 2 with the manual actuation lever in an activated position.

It should be noted that FIG. 4 shows the actuation lever 6 in an unactuated state, while FIG. 7 shows the actuation lever 6 in an actuated state.

Figure 9:
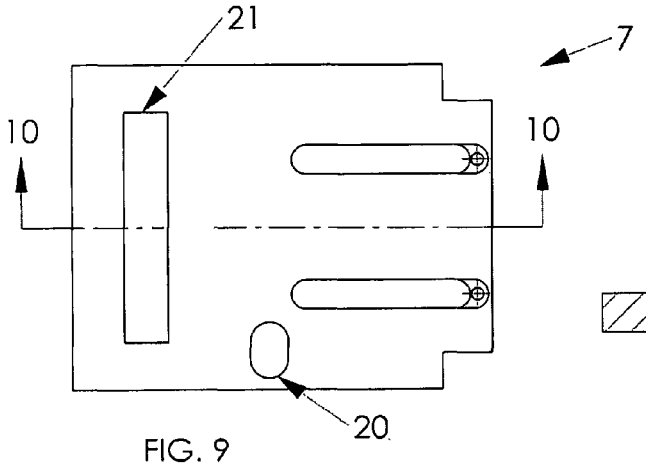
FIG. 9 is a top view of a shuttle from the magazine loading device in FIG. 1.
Figure 10:
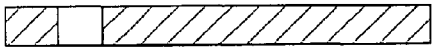
FIG. 10 is a cross-sectional view taken along line 10-10 in FIG. 9.

Looking now to FIG. 7, we can see that a shuttle 7 may be mechanically linked to the plunger 10 by a shuttle linkage 19. The shuttle linkage 19 may drive a shuttle actuation pin 76 (shown in FIG. 16) that may be encased in a shuttle linkage drive slot 20 (shown in FIG. 9). Considering this mechanical linkage, it should be noted that the shuttle 7 may be actuated by actuating the actuation lever, by a mechanical link to the plunger 10, the actuation of which has been previously described.

Referring still to FIG. 7, we can see that when the shuttle 7 is in its retracted state, a round of ammunition 4 may drop into a shuttle ammunition slot 21, which may be a profile cut through the shuttle 7.

Figure 11:
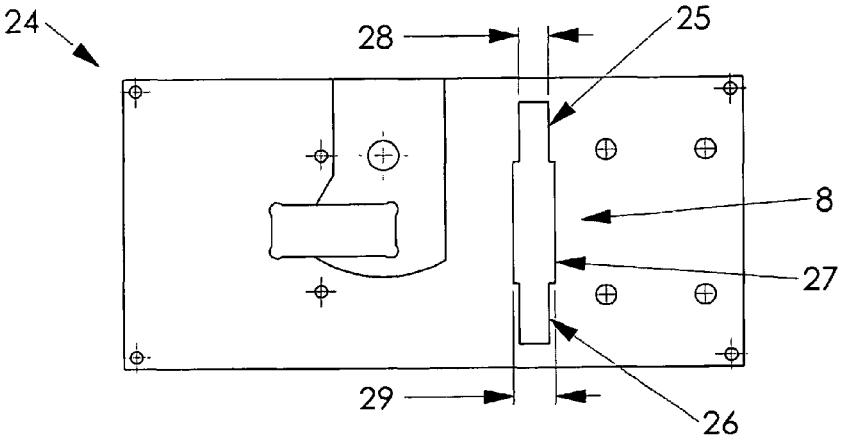
FIG. 11 is a plan view of a member containing an orientation gate.

Looking now back to FIG. 4, we can see that when the shuttle 7 is in its extended state, the round of ammunition 4 may be positioned above an orientation gate 8, which may be a profile cut through a member, like the member 24 shown in FIG. 11. This change in position of the round of ammunition 4 during actuation of the shuttle 7 may be facilitated by the shuttle ammunition slot 21 containing the round of ammunition 4, urging it into position.

It must be understood that orientation terms such as "proximal" and 'distal" and "top" and "bottom" are for semantic convenience only, and do not limit the orientation of the magazine loading device, as the magazine loading device may be used in various orientations.

Looking now at FIG. 11, we can see the member 24 that may comprise the orientation gate 8. The orientation gate 8 may comprise a proximal projectile passage 25 and a distal projectile passage 26, both with a projectile passage width 28, and a central casing passage 27 with a casing passage width 29. The profile of the orientation gate 8 may pass completely through the member 24. It may be noted that the projectile passage width 28 is narrower than the casing width passage 29, but is wider than the previously described projectile width 30. It may also be noted that the casing passage width 29 is greater than the previously described casing width 31. Considering these geometric relationships, it may be concluded that the casing end 23 of the ammunition 4 may not pass through the proximal projectile passage 25 or the distal projectile passage 26, but that the projectile end 22 of the ammunition 4 may pass through either the proximal projectile passage 25 or the distal projectile passage 26. Because of this, the projectile end 22 of the ammunition 4 must always pass through the orientation gate 8 first. This should result in each round of ammunition 4 being oriented the same way regardless of its orientation when placed in the hopper 2.

Figure 14:
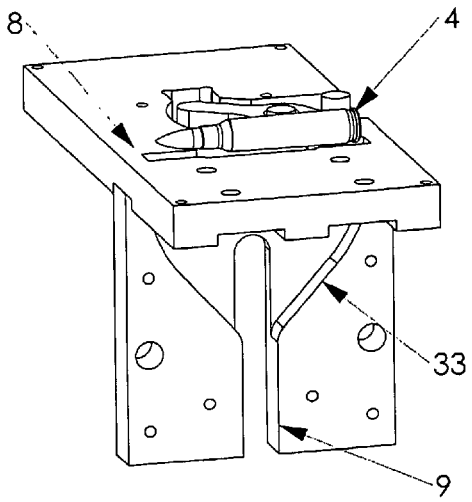
FIG. 14 is a perspective view of internal component parts of the magazine loading device, showing a round of ammunition above the orientation gate.

FIGS. 14, 15, 16 and 17 demonstrate this concept sequentially. FIG. 14 shows the start of the orientation process described above and each subsequent Fig. shows the progression of the ammunition 4 as it becomes oriented with the projectile end 22 pointed downwards. These illustrations show ammunition 4 is one orientation, but it must be acknowledged that the same process would take place if it was initially oriented the opposite way. Various components of the invention are hidden in these views in order to clearly represent the orientation process.

In FIG. 14, we see the ammunition 4 positioned above the orientation gate 8. This position may be achieved by the actuation of the shuttle 7 (shown in FIGS. 4 and 7). An exemplary actuation is described above.

Figure 15:
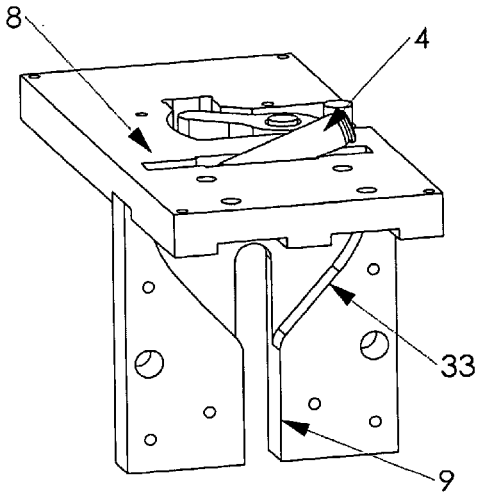
FIG. 15 is a perspective view of the component parts shown in FIG. 9 with the round of ammunition entering the orientation gate.

Looking now to FIG. 15, we can see that the projectile end 22 (not shown) of the ammunition 4 has dropped through the proximal projectile passage 25 of the orientation gate 8. As a result, the ammunition 4 begins to slide into the central casing passage 27 of the orientation gate 8. This sliding is facilitated by the angle of the ammunition as the projectile end 22 drops through the orientation gate 8 and by the fact that the casing end 23 cannot fit through the projectile passages 25 and 26.

Figure 16:
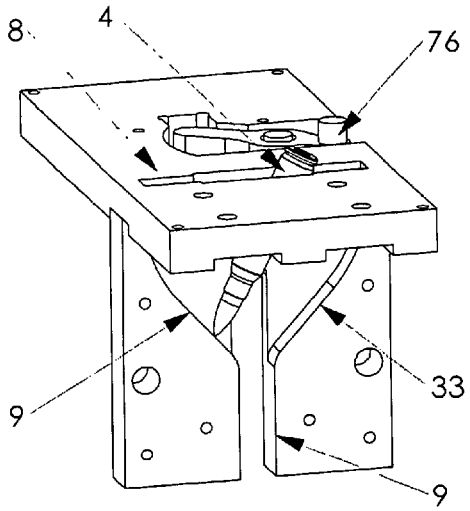
FIG. 16 is a perspective view of the component parts shown in FIG. 10 with the round of ammunition entering the staging gate.
Figure 17:
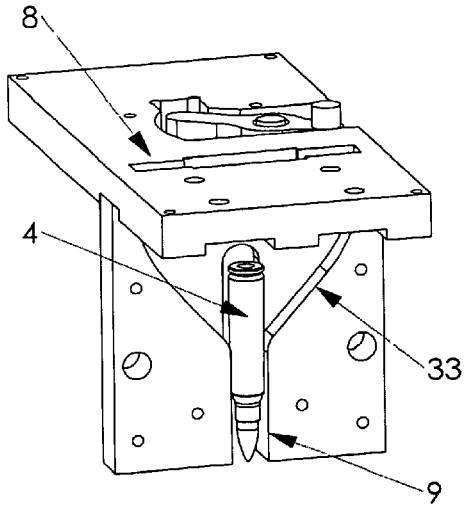
FIG. 17 is a perspective view of the component parts shown in FIG. 11 with the round of ammunition oriented and staged.

In FIG. 16, we can see that the staging gate passage 33 is shaped so that it may guide the ammunition 4 into the staging gate 9, urging the ammunition 4 into a substantially vertical orientation with the projectile end 22 facing down. The resulting orientation of the ammunition 4 observed in FIG. 17 is typically the preferred orientation for loading the ammunition 4 into the magazine 3.

Referring back to FIG. 4, it may be noted that the ammunition 4 shown in the hopper 2 is parallel in orientation but may be oriented with the projectile end 22 and the casing end 23 oriented in either direction. The operation described above ensures that the ammunition is oriented correctly after passing through the orientation gate 8.

Referring back to FIG. 7, we can see the ammunition 4 pushed into position by the plunger 10 urging the ammunition 4 into position as the plunger 10 is actuated. It must be understood that this urging of the ammunition 4 is adequate in position and in pressure to force the ammunition 4 into the magazine 3.

It should also be noted that due to the shuttle 7 being mechanically linked to the plunger 10, the fully forward stroke of the plunger 10 causes the shuttle 7 to reach the position shown in FIG. 7 so that another round of ammunition 4 may be received. Due to this relationship, once the magazine 3 is full of ammunition 4, the shuttle 7 may not reach the position required to accept another round of ammunition 4. This may prevent overloading of the magazine 3.

It should also be noted that the crank shaft 14 and its associated guides and bearings may be affixed to slideable members (not shown), which may be held in place by spring force, thereby allowing the slideable members to retract when subjected to higher force than is required for normal operation. This may prevent excessive force from being applied when the actuation lever 6 is actuated.

Figure 12:
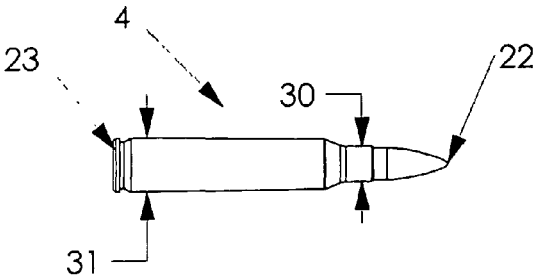
FIG. 12 is an exemplary round of ammunition oriented with the projectile facing to the right.
Figure 13:
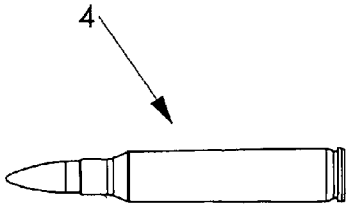
FIG. 13 is an exemplary round of ammunition oriented with the projectile facing to the left.
Figure 18:
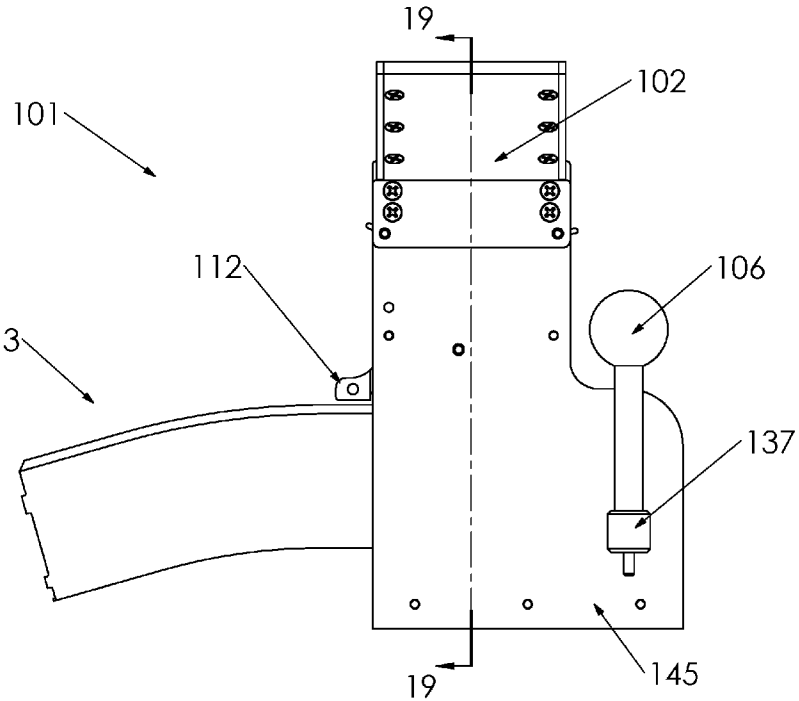
FIG. 18 is a side elevation view of a magazine loading device with a feed hopper installed and a magazine inserted.

In FIG. 18, there is illustrated another magazine loading device 101 for insertion of ammunition 4 into a detachable magazine 3. The ammunition 4 is illustrated in FIG. 12 and has been previously described in paragraph 0055, The magazine loading device 101 may comprise an assembly including a proximal housing plate 145, a distal housing plate 146 (shown in FIG. 19), a hopper 102, an actuation lever 106, an actuation lever adapter 137, a crank shaft 114 (shown in FIG. 22), an actuation cam 115 (shown in FIG. 22), a plunger 110 (shown in FIG. 22), a rocker 140 (shown in FIG. 24), an escapement 142 (shown in FIG. 20), an escapement actuator 143 (shown in FIG. 22), and a plunger interlock 161 (shown in FIG. 22), in addition to various other components.

Figure 19:
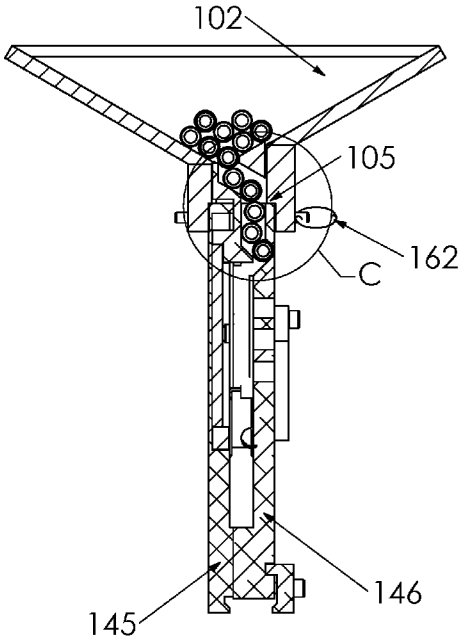
FIG. 19 is a cross-sectional view taken along the line 19-19 in FIG. 18.
Figure 20:
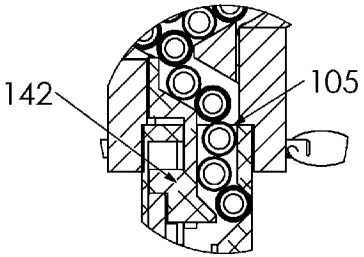
FIG. 20 is an enlarged detail view taken within the circle C in FIG. 19.

Looking now to FIG. 19 we can observe the ammunition 4 may be delivered to an ammunition delivery interface 105 by means of the hopper 102. It may alternately be delivered by individually manually loading or by some other delivery, including an alternate fixed or detachable ammunition delivery system (not shown). A hopper 102 may be secured to the magazine loading device with screws or other fasteners (not shown), with hopper release pins 162, or some other securement (not shown).

Figure 22:
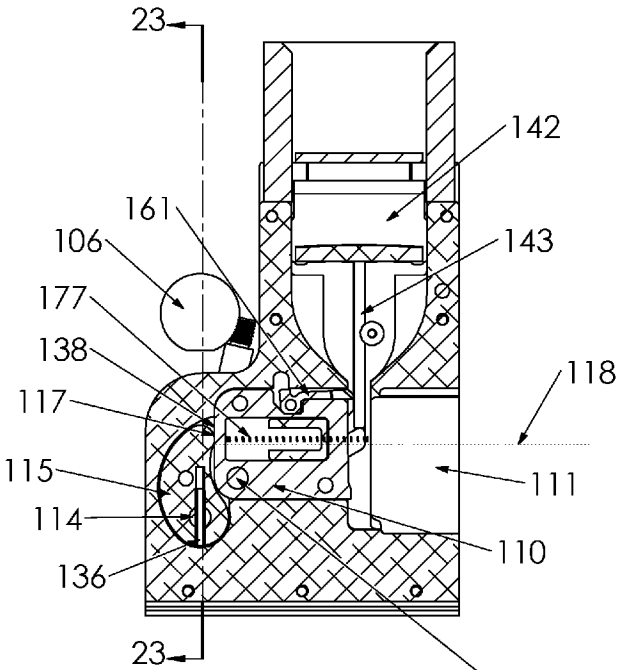
FIG. 22 is a cross-sectional view taken along the line 22-22 in FIG. 21.
Figure 21:
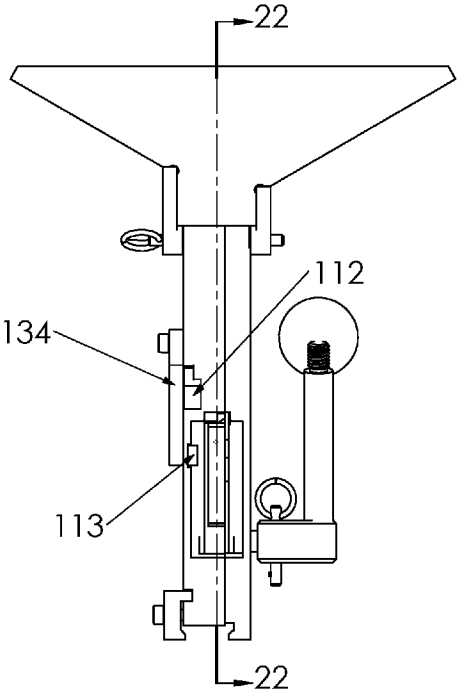
FIG. 21 is a front view of the magazine loading device with no magazine inserted.

The magazine 3 shown in FIG. 18 may be attached to the magazine loading device 101 by inserting it into the magazine receiver 111, which is shown in FIG. 22. In FIG. 21, we can see a magazine retaining pin 113, which may be maintained in position with resistible force. This resistible force may be exerted by flex in a magazine retaining pin arm 134, from an external spring (not shown), or from another source. The magazine retaining pin 113 may retract, resisted by the aforementioned resistible force, as the geometry of the magazine 3 urges it into a retracted state, overcoming the resistible force during insertion of the magazine 3. An indention pocket 75 (shown in FIG. 2) may be present in the magazine 3 with which the magazine retaining pin 113 may interlock after the magazine 3 is fully inserted into the magazine receiver 111, thus preventing the magazine 3 from being ejected from the magazine receiver 111 until the magazine retaining pin 113 is retracted. Retraction of the magazine retaining pin 113 may be facilitated by actuation of a release lever 112, as shown, by an alternative release lever, or by some other release. The magazine release lever 112 may be mechanically linked to the magazine retaining pin 113, such as by a cam, linkage, by direct mechanical cooperation, or by some other connection, so that when the magazine release lever 112 is actuated, the magazine retaining pin 113 is retracted adequately to free the magazine retaining pin 113 from the indention pocket (not shown) in the magazine 3 so that the magazine 3 can be removed.

Figure 23:
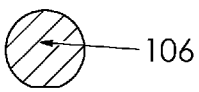
FIG. 23 is a cross-sectional view taken along the line 23-23 in FIG. 22.
Figure 23:
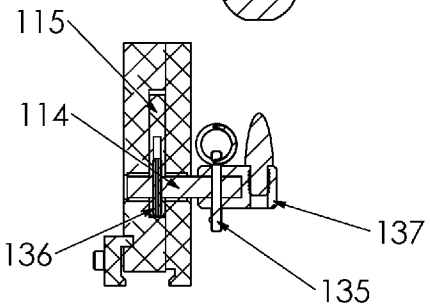

Looking now at FIGS. 22 and 23, it may be observed that the actuation lever 106 may be attached to the actuation lever adapter 137, which may be attached to the crank shaft 114. Rotational movement of the actuation lever 106 with respect to the crank shaft 114 may be prevented by an actuation lever release pin 135. Thus, when the actuation lever release pin 135 is in place, as the actuation lever release pin 135 may be for operation of the magazine loading device 101, rotational movement of the actuation lever 106 may cause the crank shaft 114 to rotate. It must be understood at this point that while this embodiment of a magazine loading device 101 may utilize a limited rotation actuation lever 106, other forms of actuation could be employed, including but not limited to constant rotation actuation and linear actuation, and that this actuation could be manually actuated or actuated by motors, linear actuators, or other forms of actuation. The specific manner of actuation employed does not limit this invention or specification.

Still referring to FIGS. 22 and 23, the actuation cam 115 may also be attached to the crank shaft 114. Rotation of the actuation cam 115 with respect to the crank shaft 114 may be resisted by an actuation cam pin 136, so that when the crank shaft 114 is rotated, the surface 117 of the actuation cam 115 may apply force to the surface 138 of the plunger 110, urging the plunger 110 towards the magazine receiver 111 along a plunger actuation axis 118. Therefore, when the actuation lever 106 is rotationally actuated, the actuation cam 115 may ultimately urge the plunger 110 along the plunger actuation axis 118. When the actuation lever 106 is rotated in the opposite direction, causing the surface 117 of the actuation cam 115 to move away from the surface 138 of the plunger 110, the plunger 110 may be urged towards the actuation cam 115 along the plunger actuation axis 118 by mechanical linkage (not shown), a plunger return spring 177, or some other return.

Figure 24:
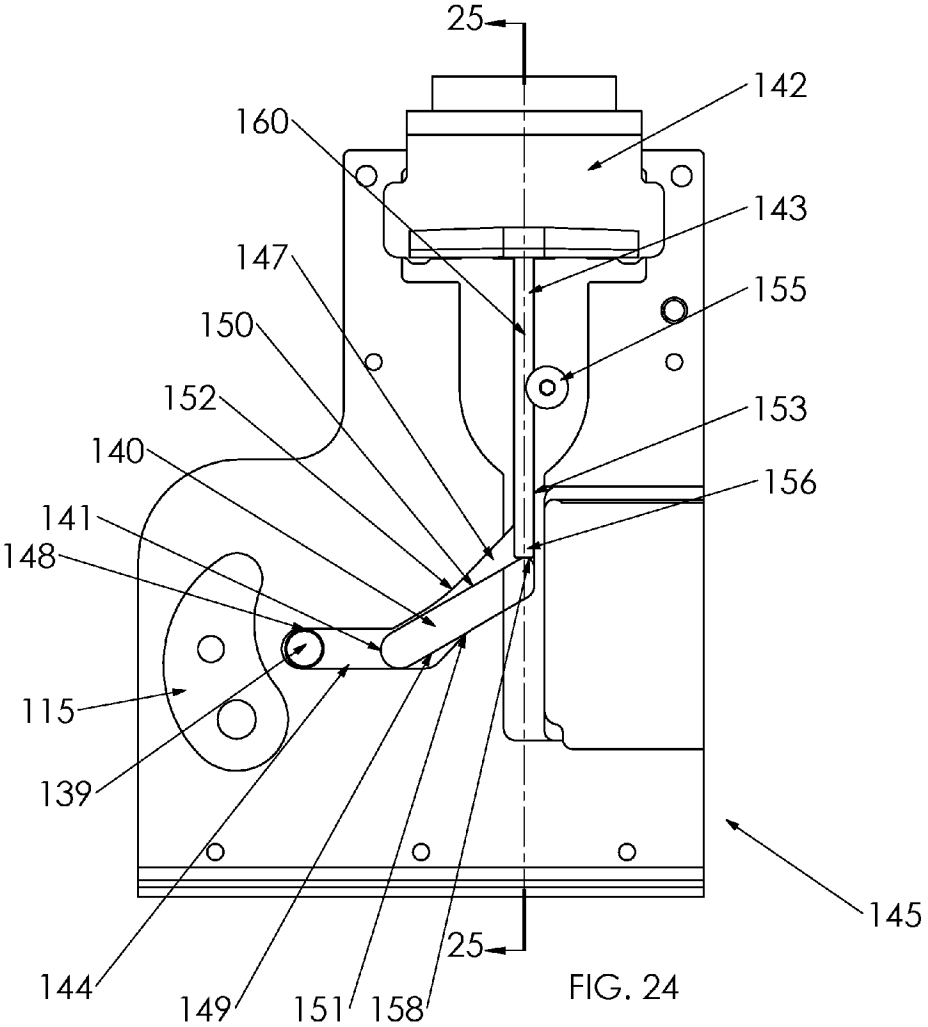
FIG. 24 is an enlarged cutaway view of the magazine loading device in elevation with some components hidden or removed.

Moving our attention to FIG. 24, we can see an illustration of a rocker actuator 139. The rocker actuator 139 may be formed into or mechanically fixed with respect to the plunger 110, but in order to provide the illustration clearly, the plunger 110 is hidden in this illustration. It should be noted that due to the fixed position of the rocker actuator 139 with respect to the plunger 110, when the plunger 110 is moved along the plunger actuation axis 118, the rocker actuator 139 is also moved along the plunger actuation axis 118.

Still looking at FIG. 24, we can see that there is a rocker actuator pocket 144, which may be formed into the proximal housing plate 145 or distal housing plate 146, or partially formed into each. The rocket actuator pocket 144 may form a passage for movement of the rocker actuator 139 and may be substantially parallel to the plunger actuation axis 118. The rocker actuator pocket 144 may terminate in a rocker pocket 147, which may be shaped to allow some movement of the rocker 140 with respect to the proximal housing plate 145, while also providing mechanical limits for such movement. It may be observed that when the surface 148 of the rocker actuator 139 is positioned in abutment to the surface 141 of the rocker 140, the rocker 140 may be urged along the plunger actuation axis 118, positioning the lower surface 149 of the rocker 140 in abutment to the lower rocker pocket lobe 151 of the rocker pocket 147. Further movement of the rocker 140 may cause the rocker 140 to pivot in the rocket pocket 147, guided by the lower rocket pocket lobe 151 on the bottom and the upper rocker pocket lobe 152 on the top.

Figure 25:
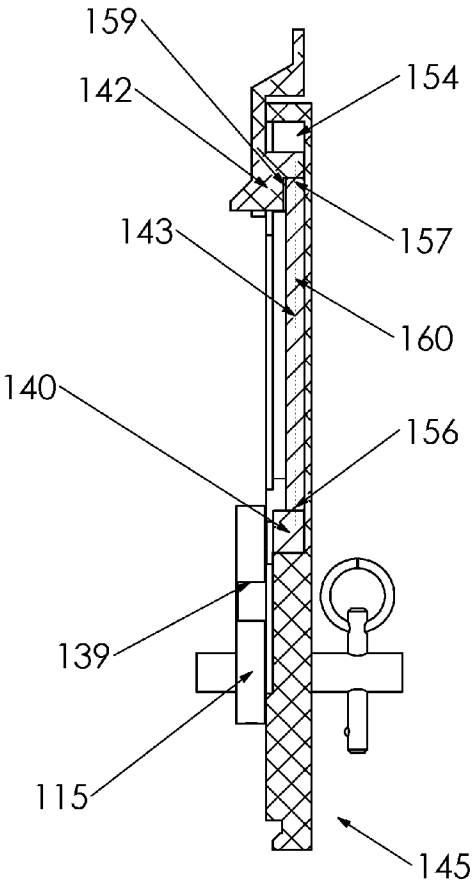
FIG. 25 is a cross-sectional view taken along the line 25-25 in FIG. 24.

Remaining on FIG. 24, there is illustrated an escapement actuator 143 with a lower end 156 and an upper end 157 (shown in FIG. 25). It may be observed that the face of the lower end 156 of the escapement actuator 143 is in abutment to the rocker pushing surface 158 of the rocker 140, and the upper end 157 of the escapement actuator 143 is in abutment to the escapement actuator pocket 159 of the escapement 142. Thus, when the rocker 140 is actuated by the rocker actuator 139, the actuating surface 158 of the rocker 140 may urge the escapement actuator 143 along an escapement actuation axis 160. This may cause the upper end 157 of the escapement actuator 143 to push on the escapement 142, urging it along the escapement actuation axis 160. When the rocker 140 is actuated in the reverse direction, the escapement actuator 143 and escapement 142 may remain in abutment with one another and move respectively along the escapement actuation axis by gravity, spring force, mechanical linkage, or some other force. Thus, when the actuation lever 106 is rotated in either direction, it may ultimately provide motion to the actuation cam 115, plunger 110, and escapement 142.

With an understanding of how the actuation cam 115, plunger 110, and escapement 142 are actuated, we shall now describe the operation of these components in relation to a magazine loading device 101. The operation shall be limited with respect to how one round of ammunition 4 travels through the magazine loading device 101 and into the magazine 3.

The loading of a round of ammunition 4 into a magazine 3 begins when the ammunition 4 passing through the ammunition delivery interface 105.

Figure 28:
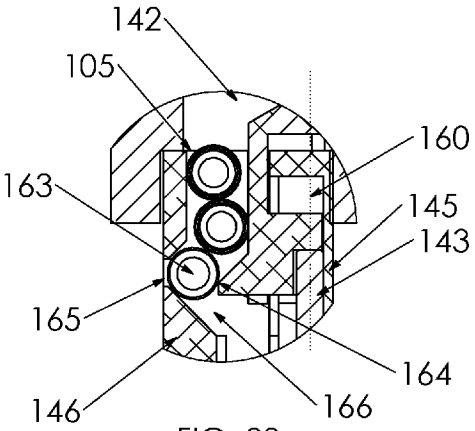
FIG. 28 is an enlarged detail view taken with the circle D in FIG. 27.
Figure 26:
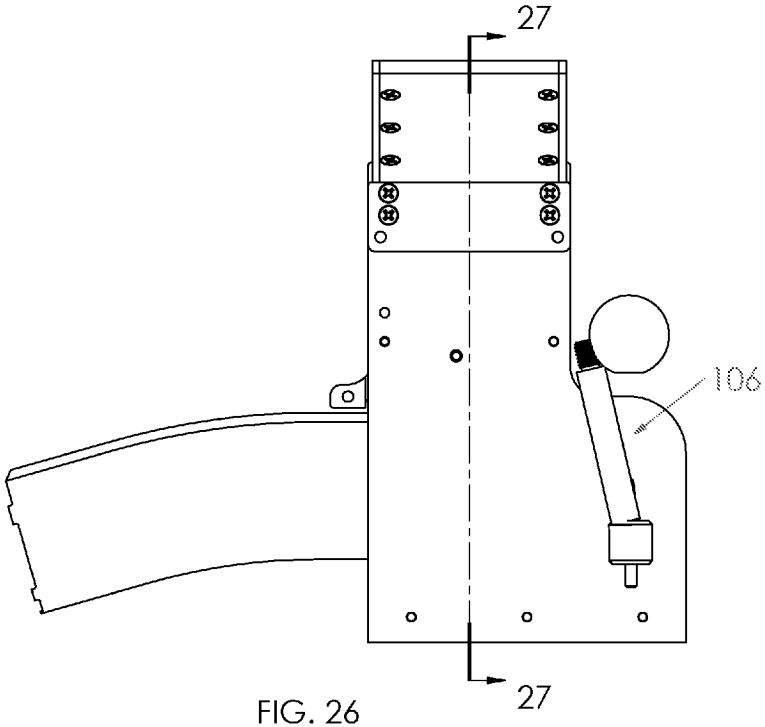
FIG. 26 is an elevation view of the magazine loading device with a magazine inserted, in an unactuated state.

The ammunition 4 then passes through the escapement 142. In FIG. 28, we can see three rounds of ammunition 4 that have passed through the ammunition delivery interface 105 and are staged, with further movement resisted by the escapement 142. Looking specifically now at the round of ammunition 163, we can see that it is being held in position by the escapement release lip 164 and the ammunition staging pocket 165 of the distal housing plate 146. This is because when the escapement 142 is in an unactuated state, the escapement passage 166 is too narrow for the ammunition 163 to pass through. As previously described, the escapement 142 moves along the escapement actuation axis 160 when the actuation lever 106 is actuated. Note in FIG. 26 that the actuation lever 106 is illustrated to be in the retracted or unactuated state.

Figure 31:
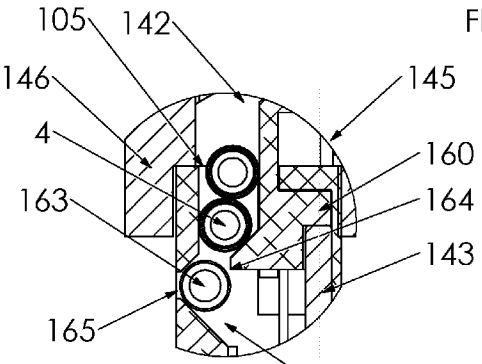
FIG. 31 is an enlarged detail view taken with the circle E in FIG. 30.
Figure 29:
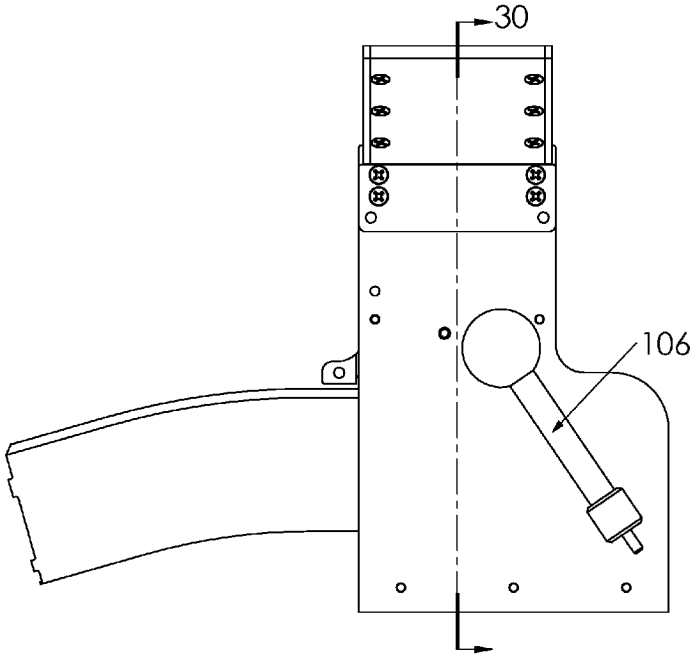
FIG. 29 is an elevation view of the magazine loading device with a magazine inserted, in an actuated state.

Moving now to FIG. 29, we see the actuation lever 106 in the extended or actuated state. Illustrated in FIG. 31, we can see the effect of this actuation on the escapement 142 position. In the actuated position, the alignment of the escapement release lip 164 with respect to the ammunition staging pocket 165 may be arranged so that the escapement passage 166 is wide enough to allow the ammunition 163 to pass through it, while preventing the next round of ammunition 4 from passing through. This enables the escapement 142 to release one round of ammunition 163 with each actuation of the actuation lever 106, which may be a principle function of the escapement 142.

Figure 27:
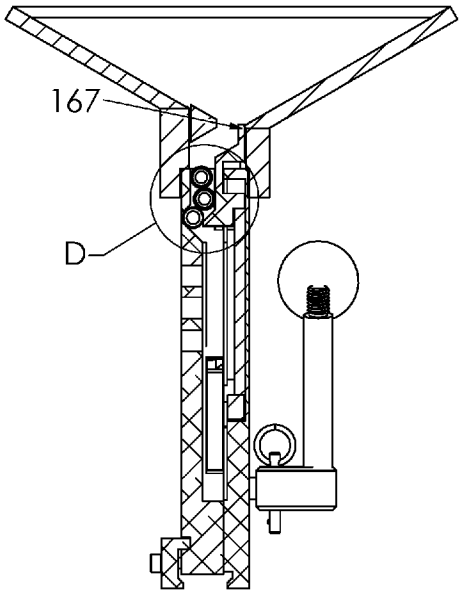
FIG. 27 is a cross-sectional view taken along the line 27-27 in FIG. 26.
Figure 30:
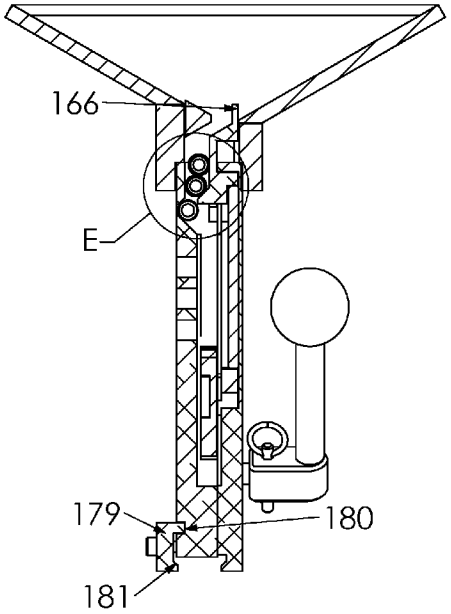
FIG. 30 is a cross-sectional view taken along the line 30-30 in FIG. 29.

Another function of the escapement 142 may be to provide agitation to rounds of ammunition 4 that are in the hopper 2, which may improve the flow of the ammunition 4 through the hopper 2. In FIG. 27, we see a hopper agitation lip 167 in its retracted state. In FIG. 30, we see a hopper agitation lip 167 in its extended state. We can see that in this embodiment the hopper agitation lip 166 is of a substantially narrow shape that is formed into the escapement 142, but the hopper agitation lip 167 may exist as an independent member or part of another member and may also be of a different shape.

After the ammunition 163 is through the escapement 142, the ammunition 163 is oriented with the projectile facing down. This may be accomplished with an orientation gate 108. It should be noted that the orientation gate 108 may be substantially similar in size, shape, and function as the orientation gate 8 described in paragraph 0063, but in this embodiment, the orientation gate 108 may be shaped partially by features in the proximal housing plate 145 and partially by features in the distal housing plate 146, so that when the proximal housing plate 145 and the distal housing plate 146 are assembled, their respective features cooperate to form the orientation gate 108.

Figure 33:
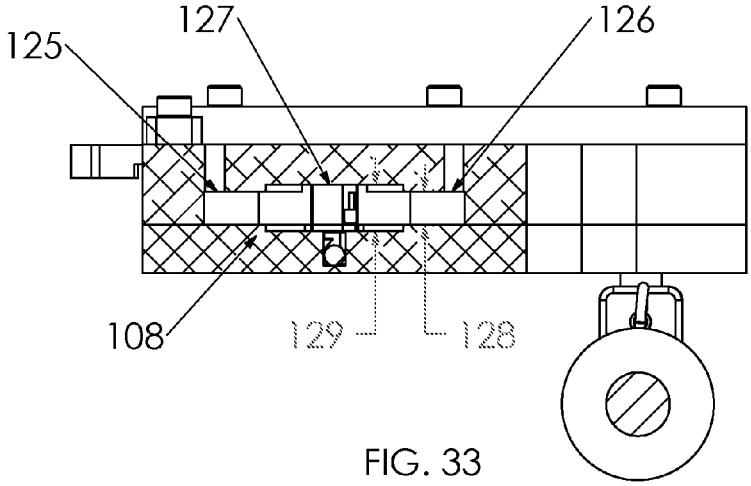
FIG. 33 is a cross-sectional view taken along the line 33-33 in FIG. 32.
Figure 32:
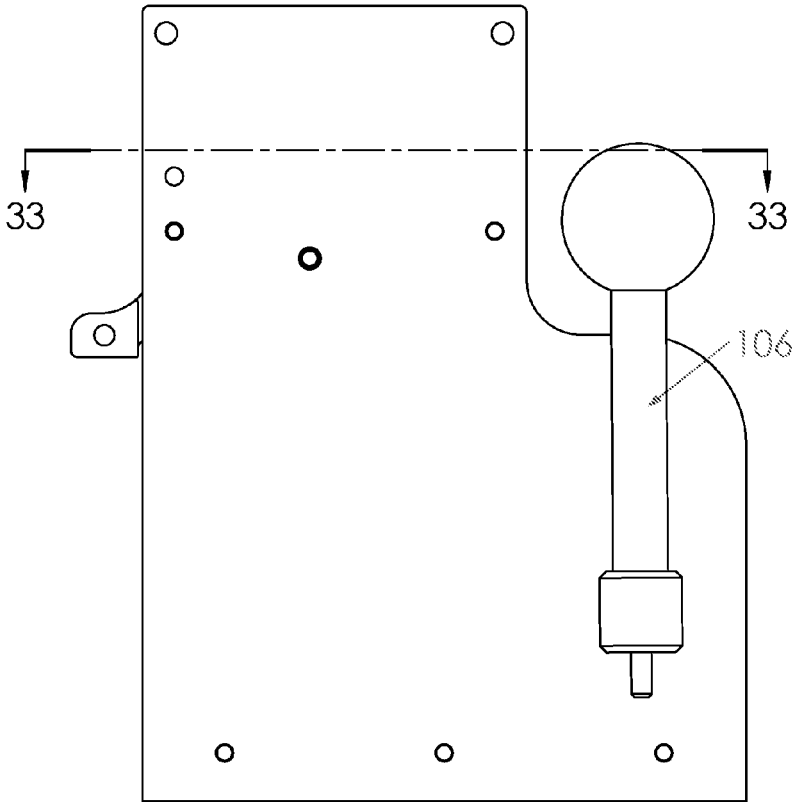
FIG. 32 is an elevation view of the magazine loading device with some components hidden or removed.

In FIG. 33, there is illustrated a proximal projectile passage 125 and a distal projectile passage 126 both with a projectile passage width 128, and a central casing passage 127 with a casing passage width 129. It should be noted that the projectile passage width 128 may be narrower than the casing passage width 129, but wider than the previously described projectile width 30. It should also be noted that the casing passage width 129 may be greater than the previously described casing width 31. Considering these geometric relationships, it may be concluded that the casing end 23 of the ammunition 4 may not pass through the proximal projectile passage 125 or the distal projectile passage 126, but that the projectile end 22 of the ammunition 4 may pass through either the proximal projectile passage 25 or the distal projectile passage 26. Because of this, the projectile end 22 of the ammunition 4 should pass through the orientation gate 108 first. This may result in each round of ammunition 4 being oriented the same way regardless of its orientation when introduced to the orientation gate 108 through the ammunition delivery interface 105.

Figure 34:
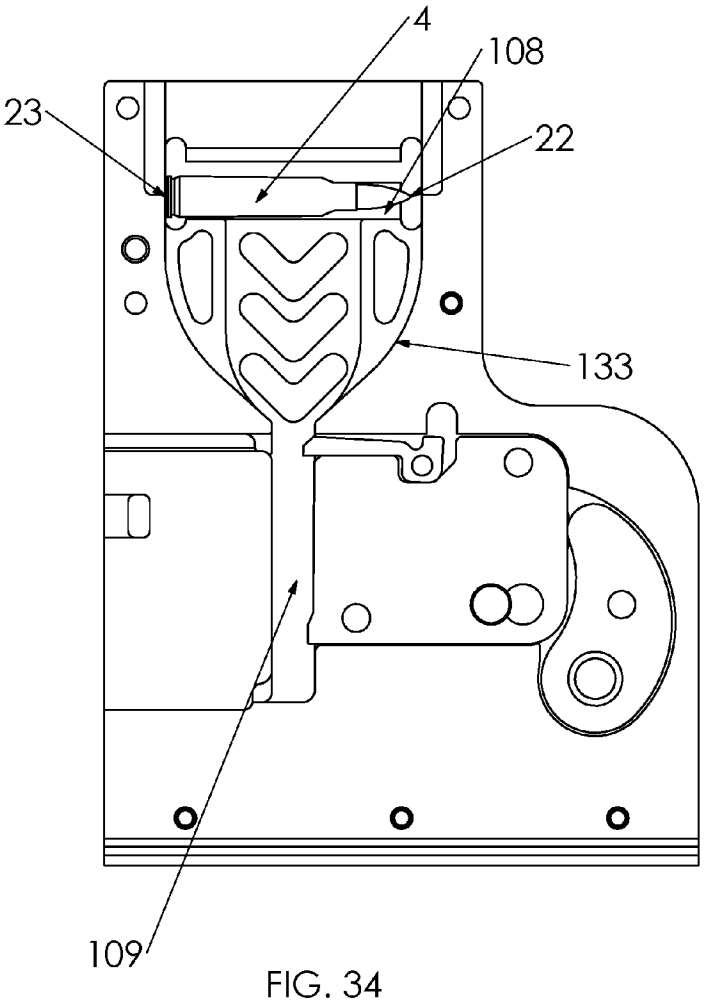
FIG. 34 is an elevation view of internal component parts of the magazine loading device, showing a round of ammunition before entering the sorting gate.

FIGS. 34, 35, 36, and 37 demonstrate sequentially the passage of the ammunition 4 through the orientation gate 108. FIG. 34 shows the start of the orientation of the ammunition 4 and each subsequent view shows the progression of the ammunition 4 as it becomes oriented with the projectile end 22 pointed downwards. These illustrations show ammunition 4 initially orientated with the projectile end 22 facing to the right when viewing FIG. 34, but it must be understood that the same process would take place if the ammunition 4 was initially oriented in the opposite direction (i.e., with the projectile end 22 facing to the left). Various components of the invention are hidden in these views in order to clearly represent the orientation process.

In FIG. 34, we see the ammunition 4 positioned above the orientation gate 108. The ammunition 4 may reach this position after being release by the escapement 142 as described above.

Figure 35:
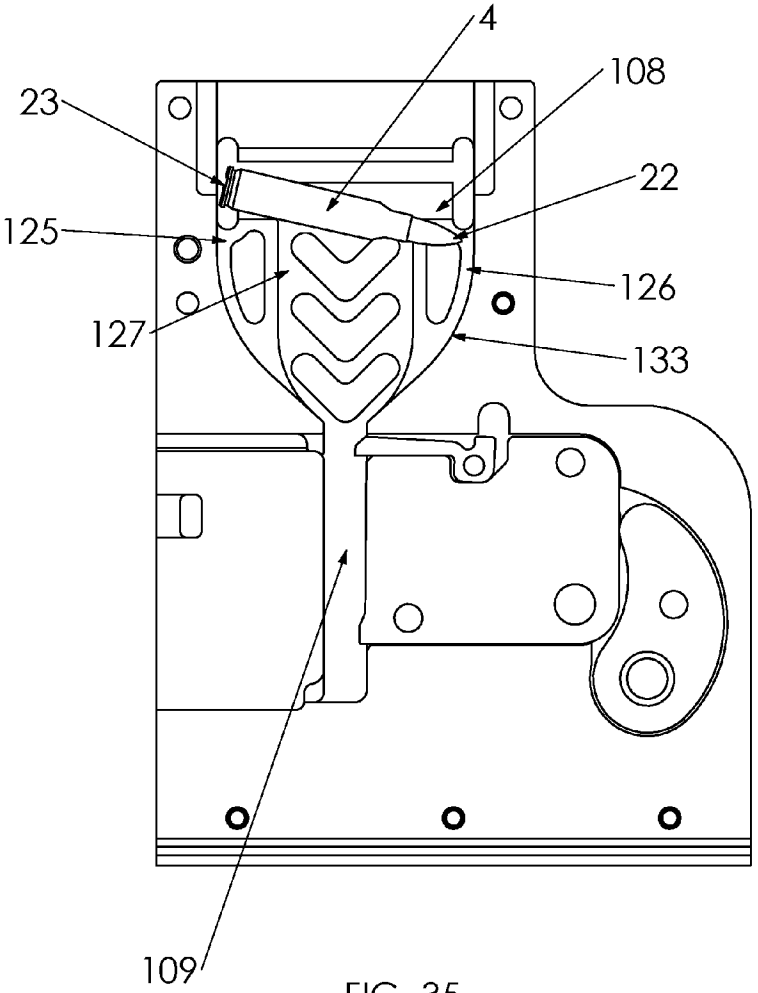
FIG. 35 is an elevation view of component parts of the magazine loading device, showing a round of ammunition after entering the sorting gate.

Looking now to FIG. 35, we can see that the projectile end 22 of the ammunition 4 is starting to drop through the distal projectile passage 126 of the orientation gate 108. As a result, the ammunition 4 has begun to slide into the central casing passage 127 of the orientation gate 108. This sliding may be facilitated by the increasing angle of the ammunition as the projectile end 22 drops through the orientation gate 108, and by the fact that the casing end 23 cannot fit through the projectile passages 125 and 126.

Figure 36:
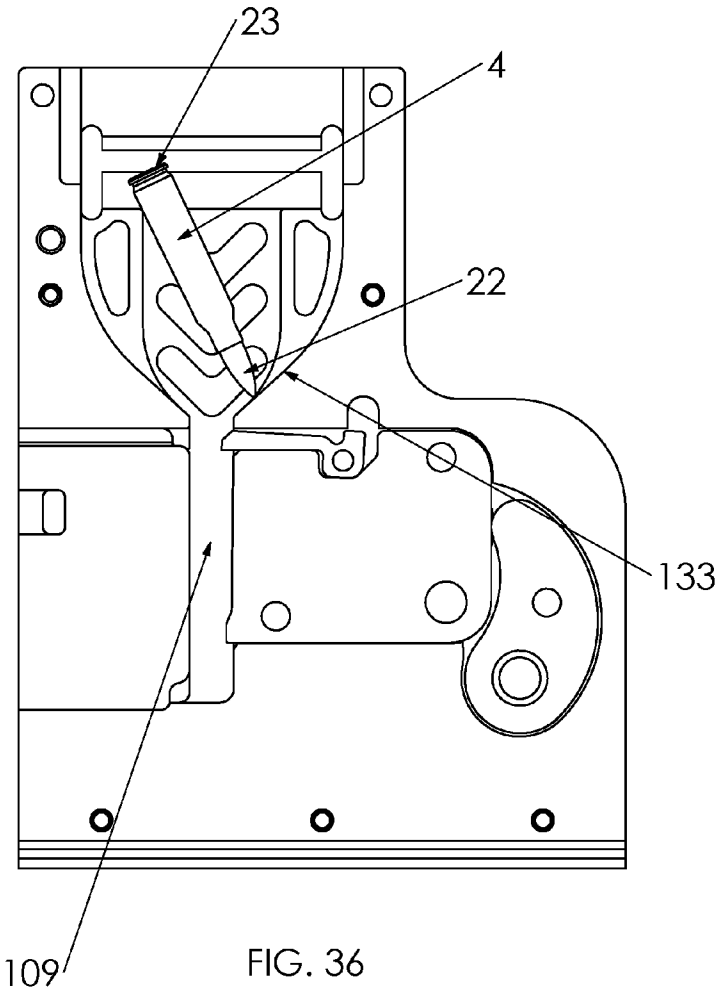
FIG. 36 is an elevation view of the component parts shown in FIG. 35, showing a round of ammunition before entering the staging gate.

In FIG. 36, we can see that the staging gate passage 133 is shaped so that it may guide the ammunition 4 into the staging gate 109, urging it into a substantially vertical orientation with the projectile end 22 facing down. The resulting orientation of the ammunition 4 at the staging gate 109 may be observed in FIG. 37, which may be the preferred orientation for loading the ammunition 4 into the magazine 3.

Figure 37:
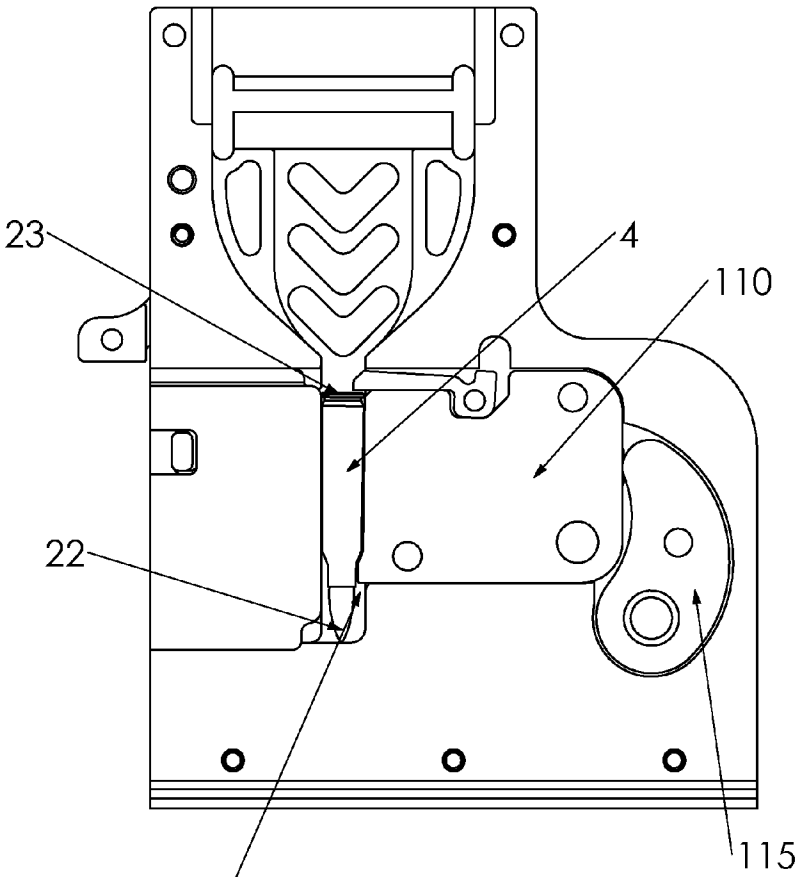
FIG. 37 is an elevation view of the component parts shown in FIG. 35, showing a round of ammunition in position at the staging gate.

Referring back to FIG. 19, it may be noted that the ammunition 4 shown in the hopper 102 is parallel in orientation but may be oriented with the projectile end 22 and the casing end 23 oriented in either direction. The invention described above ensures that the ammunition 4 is oriented with the projectile end 22 facing down after passing through the orientation gate 108. Once the ammunition 4 is in position at the staging gate 109 as shown in FIG. 37, the ammunition 4 may be urged or pushed into the magazine 3.

Figure 38:
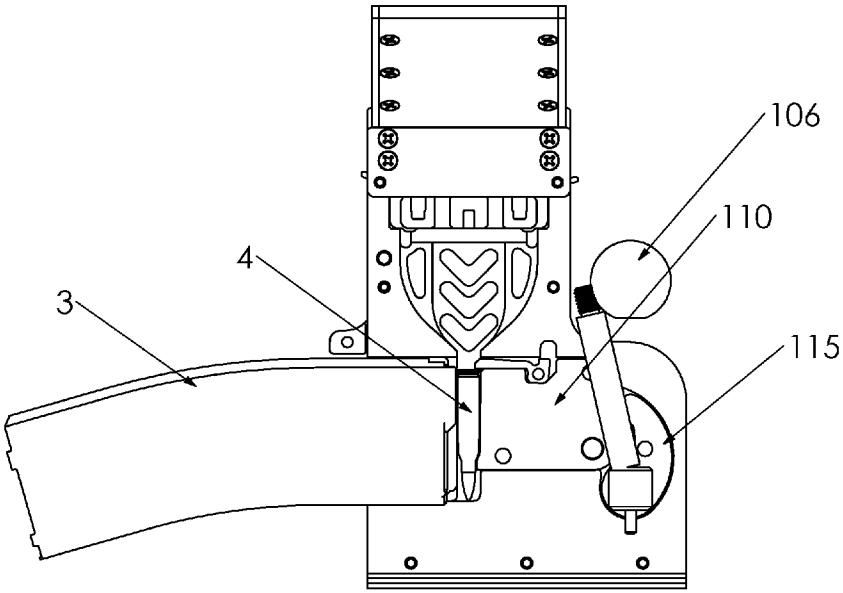
FIG. 38 is an elevation view of internal component parts of the magazine loading device in an unactuated state.
Figure 39:
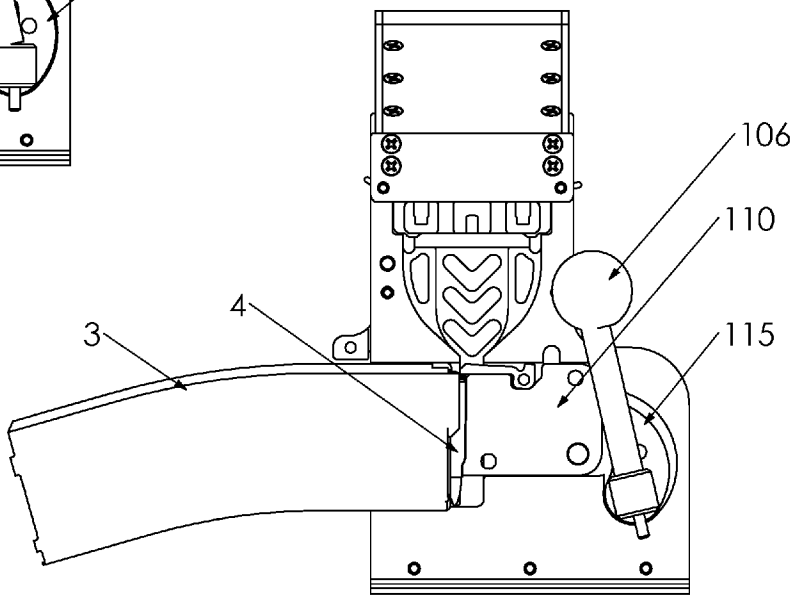
FIG. 39 is an elevation view of internal component parts of the magazine loading device in a partially actuated state.

FIG. 38 depicts a round of ammunition 4 ready to be inserted into the magazine 3, and in FIG. 39, we can see the ammunition 4 as it is first enters the magazine 3, being pushed by the plunger 110, which is ultimately actuated by rotating the actuation lever 106. It should be noted at this point that the escapement 142 (not shown) did not change positions from FIG. 38 to FIG. 39. The timing of the escapement 142 actuation may be configured by design so that the plunger 110 must be substantially forward before the escapement 142 is actuated, dropping another round of ammunition 4 through the escapement passage 166 and into the orientation gate 108. This may prevent the escapement 142 from actuating when the magazine 3 is full, because the plunger 110 may not be able to travel far enough to actuate the escapement 142 when the magazine 3 is full. This may prevent staging another round of ammunition 4 after the magazine 3 is full, which may prevent overloading the magazine 3 or having a loose round of ammunition 4 left in the staging gate 109 after the magazine 3 is full.

Figure 40:
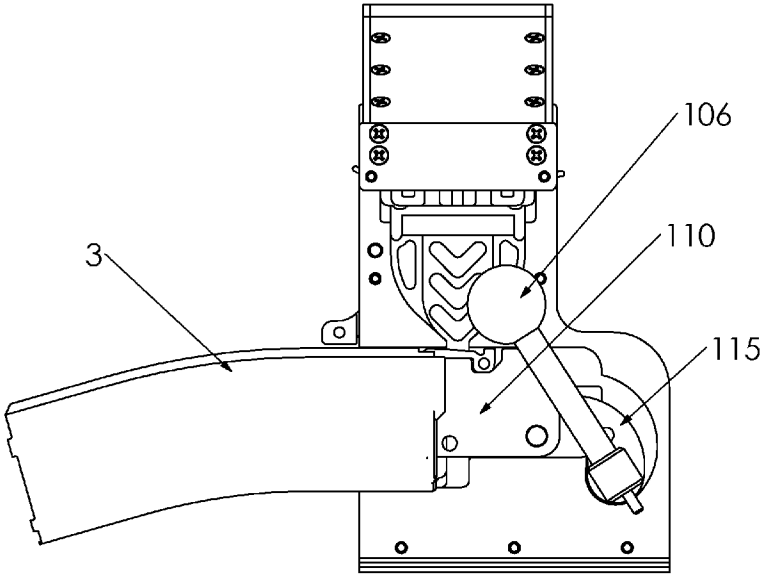
FIG. 40 is an elevation view of internal component parts of the magazine loading device in an actuated state.

Moving now to FIG. 40, we see the actuation lever 106 in its fully actuated position. It should be appreciated that, in this position, the escapement 142 is in its actuated position as well.

Figure 42:
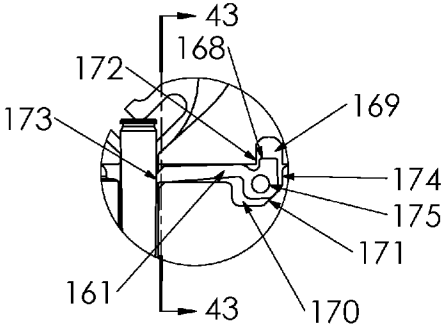
FIG. 42 is an enlarged detail view taken with the circle F in FIG. 41.
Figure 41:
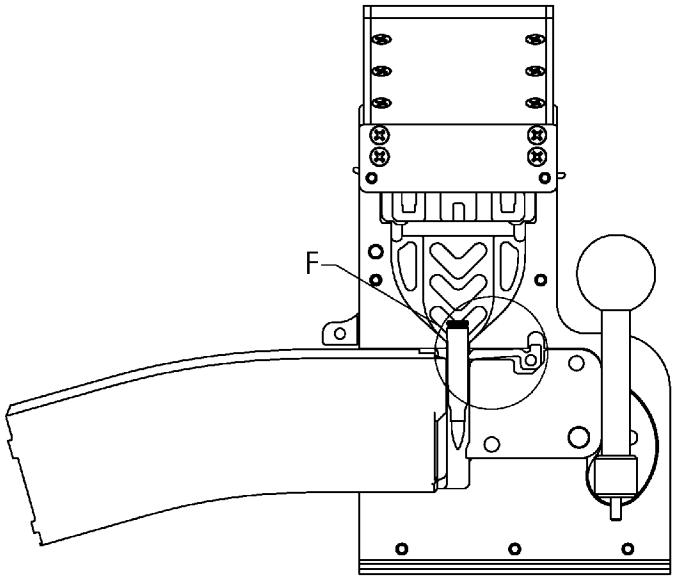
FIG. 41 is an elevation view of internal component parts of the magazine loading device in an actuated state, with a round of ammunition in the staging gate passage.

Having now described the primary functions of the magazine loading device 101, we turn our attention to FIGS. 41 and 42, where the plunger interlock 161 is illustrated in an interlock guide pocket 170. In these illustrations, it should be understood that the plunger interlock 161 may be urged back by a dropping round of ammunition 4, so that the interlock catch 168 may be positioned so that it will interfere with the interlock catch edge 172 if the plunger 110 is actuated while in this state. This may prevent the plunger 110 from pushing a round of ammunition 4 before it is fully positioned in the staging gate 9, thus preventing damage to the round of ammunition 4. This function is achieved because the leading edge 173 of the plunger interlock 161 is urged towards the interlock guide pocket stop 174 by the dropping round of ammunition 4. The plunger interlock 161 and interlock catch guide 171 cooperate to urge the interlock catch 168 into the interlock catch pocket 169, positioning the interlock catch 168 so that it may not pass by the interlock catch edge 172 if the plunger 110 is actuated. Once the round of ammunition 4 has dropped fully into place, the plunger interlock 161 may return to its normal position by spring pressure, gravity, or some other force. In this position, motion of the plunger 110 is not inhibited, thus allowing loading of a round of ammunition 4, but only once the round of ammunition 4 is properly positioned at the staging gate 109. This position is shown in FIG. 38.

Figure 43:
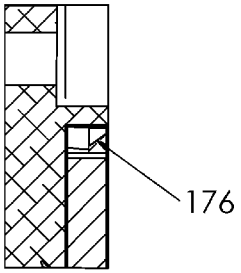
FIG. 43 is an enlarged-scale elevational view of a leading edge of a component part of the magazine loader.

It should be appreciated that the plunger interlock 161 may be formed from a lightweight material, such as a polymer. It this case, it may be desirable to add a mass to an end thereof near the interlock catch 168. The mass may be in the form of a steel pin 175, or other suitable structure. The mass is intended to function of improve the rate of travel of the plunger interlock 161 back to its normal position under the force of gravity (i.e., to the right when viewing FIG. 42). It should further be appreciated that at least a portion of the plunger interlock 161 near the leading edge 173 may be provided with a chamfered surface 176, or other suitable structure, as shown in FIG. 43. The chamfered surface 176 may interface with the round of ammunition 4 to aid in urging the plunger interlock 161 towards the interlock guide pocket stop 174. At the same time, the chamfered surface 176 encourages the passage of the round of ammunition 4 to its proper position at the staging gate 109. The chamfered surface 176 may also aid in preventing the round of ammunition 4 from catching or becoming hung-up on the plunger interlock 161.

Figure 44:
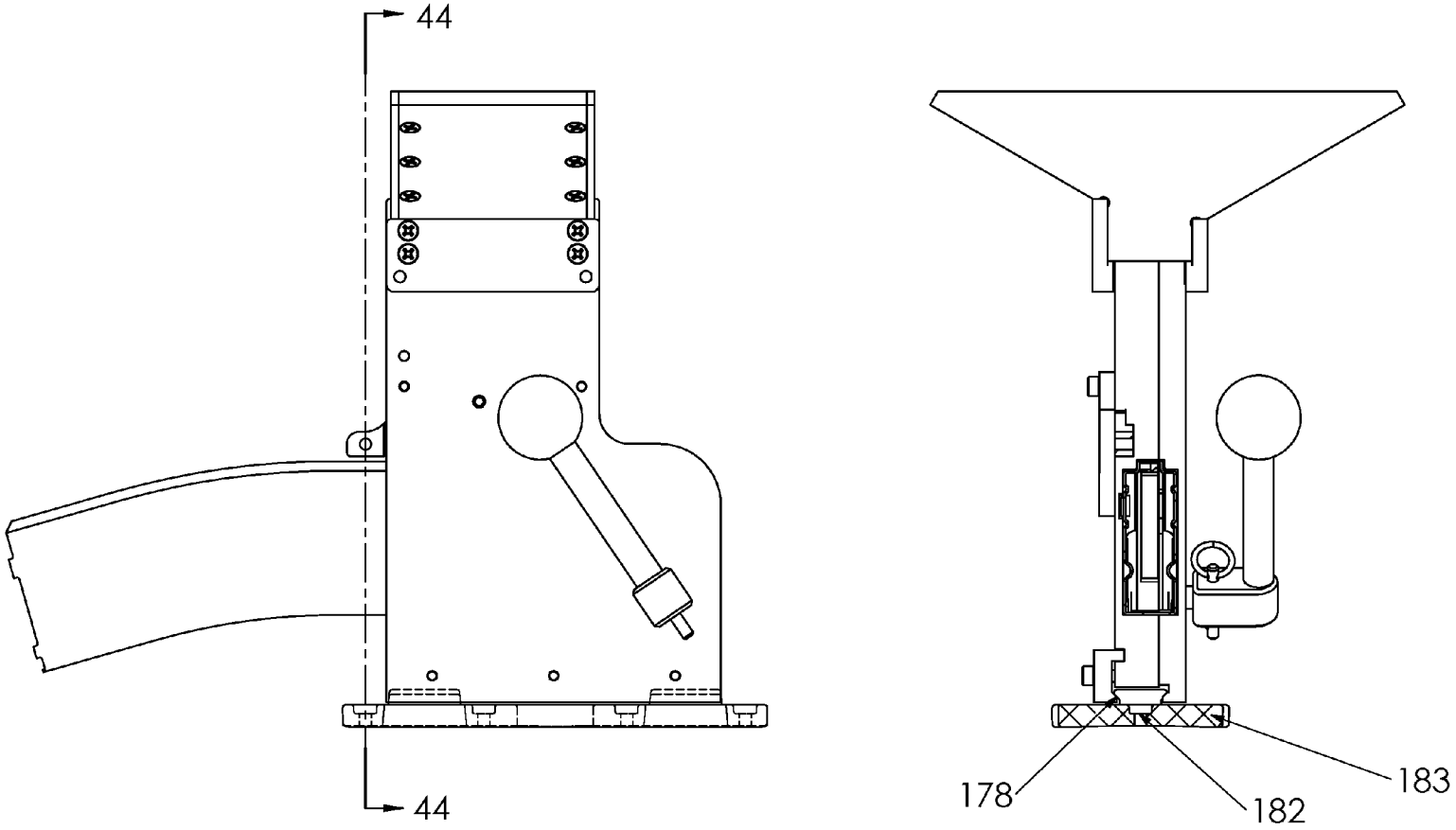
FIG. 44 is a cross-sectional view taken along the line 44-44 in FIG. 43.

The magazine loading device may be coupled to a supporting surface to stabilize the device while in use. This may be done in any suitable manner. An exemplary base 183 for coupling the device to a supporting surface is shown in FIG. 44. The base 183 may have one or more coupling features 178, which are configured to mating with complementary coupling features 179 on the bottom of the device. The coupling features 178 on the base 183 may be in the shape of a dovetail. Complementary coupling features 179 may comprise mating dovetail grooves, which may be provided on the bottom of the device. In this instance, the grooves 179 are cooperatively formed by a first fixed member 180 and a second movable member 181. The moveable member 181 may be in the form of a knob supported on a threaded shaft. As the knob is tightened, the movable member 181 moves to tighten against the dovetail, while drawing the fixed member 180 against an opposite side of the dovetail. In this way, the fixed and movable members 180, 181 may form a clamping arrangement. The base 183 may further be provided with holes, such as the counter bored holes 182 shown in FIG. 44. These holes 182 are configured to receive threaded fasteners (not shown) suitable for fastening the base 183 to a supporting surface. It should be appreciated that other structure may be suitable for coupling the device to a supporting surface, such as a rail or track. One suitable track is a track sold under the name of GEARTRAK® by YAKATTACK®, in Burkeville, Va.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A device for loading rounds of ammunition into a magazine, each round of ammunition having a casing and a projectile, the device comprising:

a shuttle having a slot therein configured to receive one of the rounds of ammunition, the shuttle being operably displaceable to move the slot to a location so as to carry the round of ammunition to the location;

an orientation gate configured to receive the round of ammunition after the round of ammunition moves from the location to the orientation gate, the orientation gate comprising a passage having at least a first portion, a second portion and a third portion, the first portion and the third portion being at opposite ends of the second portion, the first portion and the third portion having a dimension that is larger than the projectile but smaller than the casing, the second portion having a dimension that is larger than the casing, whereby travel of the projectile is permitted through the first portion or third portion, but travel of the casing is permitted through the second portion only so as to orient the round of ammunition traveling therethrough in a particular orientation; and a plunger movable in relation to the orientation gate, the plunger configured to urge the round of ammunition into the magazine after the round of ammunition travels through the orientation gate.

2. The device of claim 1, wherein the shuttle is operably displaceable to move in a substantially horizontal direction relative to the orientation gate.

3. The device of claim 1, further comprising:

a first plate, and a second plate, the passage of the orientation gate being defined at least partially therebetween.

4. The device of claim 1, further comprising:

an escapement passage in communication with the orientation gate, and an escapement operably displaceable to selectively restrict or permit passage of the round of ammunition through the escapement passage into the orientation gate.

5. The device of claim 4, wherein the escapement and the escapement passage are cooperatively dimensioned and configured to permit the traveling of a single round of the ammunition through the escapement passage at a time.

6. The device of claim 4, wherein each of the rounds of ammunition is gravity fed through the escapement passage, and the escapement is substantially vertically displaceable.

7. The device of claim 4, further comprising an actuator operatively connected to the escapement, the actuator being operable to control the displacement of the escapement.

8. The device of claim 7, further comprising:

a hopper configured to be in communication with the orientation gate, the hopper configured to hold the rounds of ammunition, and a hopper agitator operatively connected to the hopper, the hopper agitator configured to agitate the rounds of ammunition in the hopper.

9. The device of claim 4, further comprising:

a magazine receiver configured to receive a portion of the magazine, wherein the plunger is operable to extend into the magazine before the escapement is displaced to permit passage of additional rounds of ammunition through the escapement passage into the orientation gate.

10. The device of claim 4, wherein the escapement is operably configured to prevent additional ammunition from passing through the escapement passage when the magazine is completely loaded, thereby preventing the magazine from being overloaded.

11. The device of claim 1, further comprising:

a plunger interlock cooperating with the plunger to prevent the plunger from urging the round of ammunition into the magazine until the round of ammunition has completely passed through the passage in the orientation gate.

12. A device for loading rounds of ammunition into a magazine, each round of ammunition having a casing and a projectile, the device comprising:

a hopper configured to receive the rounds of ammunition;

an orientation gate configured to receive one of the rounds of ammunition from the hopper, the orientation gate comprising a passage having at least a first portion, a second portion and a third portion, the first portion and the third portion being at opposite ends of the second portion, the first portion and the third portion having a dimension that is larger than the projectile but smaller than the casing, the second portion having a dimension that is larger than the casing, whereby movement of the projectile is permitted through the first portion or third portion and movement of the casing is permitted only through the second portion so as to orient the round of ammunition moving therethrough in a desired orientation;

a magazine receiver coupled to the orientation gate, the magazine receiver configured to receive a portion of a magazine; and a plunger movable to urge the round of ammunition into the magazine after the round of ammunition moves through the passage of the orientation gate.

13. The device of claim 12, further comprising:

a shuttle having a slot therein configured to receive the round of ammunition, the shuttle being operably displaceable to move the slot to align with the orientation gate.

14. The device of claim 13, wherein the shuttle is operably displaceable to move in a substantially horizontal direction relative to the orientation gate.

15. The device of claim 12, further comprising:

a first plate, and a second plate, the passage of the orientation gate being at least partially between the first plate and the second plate.

16. The device of claim 12, further comprising:

an escapement passage in communication with the orientation gate; and an escapement operably displaceable to selectively restrict or permit movement of the round of ammunition through the escapement passage into the orientation gate.

17. The device of claim 16, wherein the escapement and the escapement passage are cooperatively dimensioned and configured to permit the passage of only one of the rounds of ammunition through the escapement passage at a time.

18. The device of claim 16, wherein each of the rounds of ammunition is gravity fed through the escapement passage, and the escapement is substantially vertically displaceable.

19. A magazine loading device comprising:

a hopper configured to hold a plurality of units of ammunition, wherein each of the units comprises a casing and a projectile;

an orientation gate coupled to the hopper, wherein:

the orientation gate defines a passage configured to receive a first one of the units from the hopper, the passage comprises a first portion, a second portion and a third portion, the second portion is located between the first portion and the third portion, the first portion and the third portion each comprise a first dimension that is larger than the projectile but smaller than the casing, the second portion comprises a second dimension that is larger than the casing, and the passage is configured to: (a) enable the projectile to move through either one of the first and third portions; and (b) enable the casing to move through the second portion without moving through the first or third portion so as to achieve an orientation of the projectile relative to the casing;

a magazine receiver coupled to the orientation gate, the magazine receiver defining an opening configured to receive a portion of a weaponry magazine; and a plunger moveably coupled to the magazine receiver, wherein the plunger is configured to be moved to apply a force to the first unit after the first unit moves through the passage, wherein the force urges the first unit into the weaponry magazine.

20. The magazine loading device of claim 19, wherein:

the magazine loading device comprises a housing that supports the orientation gate;

the housing defines a housing space configured to receive one of the units at a time; and the passage is configured so that, after each of the units moves through the passage, each of the units comprises the orientation when positioned within the housing space so that, when the units are loaded into the weaponry magazine, the projectiles of all of the units are pointed in a common direction.

* * * * *